US006254304B1

(12) United States Patent
Takizawa et al.

(10) Patent No.: US 6,254,304 B1
(45) Date of Patent: Jul. 3, 2001

(54) FASTENING BODY FOR SHEET MEMBER

(75) Inventors: Toshiaki Takizawa; Mitsuru Akeno; Tsuyoshi Minato, all of Toyama-ken (JP)

(73) Assignee: YKK Corporation, Tokyo (JP)

( * ) Notice: Subject to any disclaimer, the term of this patent is extended or adjusted under 35 U.S.C. 154(b) by 0 days.

(21) Appl. No.: 09/376,952

(22) Filed: Aug. 18, 1999

(30) Foreign Application Priority Data

Sep. 4, 1998 (JP) ..... 10-251503

(51) Int. Cl.[7] ..... A44B 18/00

(52) U.S. Cl. ..... 403/363; 248/205.2; 428/100; 24/444; 24/452

(58) Field of Search ..... 248/205.2; 428/100; 24/716, 444, 694, 452, 451; 160/330, 345; 16/87 R, 87.2; 403/294, 363, 387

(56) References Cited

U.S. PATENT DOCUMENTS

| | | | | |
|---|---|---|---|---|
| 3,732,600 | * | 5/1973 | Perina | 24/444 |
| 3,777,435 | * | 12/1973 | Perina | 428/100 X |
| 5,026,588 | * | 6/1991 | Diekmann | 428/100 |
| 5,453,309 | * | 9/1995 | Shanok et al. | 428/100 |
| 5,678,286 | * | 10/1997 | Murasaki | 24/444 |
| 5,800,760 | | 9/1998 | Takizawa et al. . | |
| 5,857,245 | * | 1/1999 | Sakakibara et al. | 24/452 |
| 5,860,194 | * | 1/1999 | Takizawa et al. | 24/452 |
| 6,060,146 | * | 5/2000 | Akeno et al. | 428/100 |

FOREIGN PATENT DOCUMENTS

| | | |
|---|---|---|
| 0 619 970 | 10/1994 | (EP) . |
| 0 753 278 | 1/1997 | (EP) . |

OTHER PUBLICATIONS

Patent Abstracts of Japan, vol. 1997, No. 05, May 30, 1997, 1 page, (JP 09 023907, Jan. 28, 1997).

* cited by examiner

*Primary Examiner*—Lynne H. Browne
*Assistant Examiner*—David E. Bochna
(74) *Attorney, Agent, or Firm*—Finnegan, Henderson, Farabow, Garrett & Dunner, L.L.P.

(57) ABSTRACT

A fastening surface body which can mount a sheet-like fastening body to a sheet-like mounting body having various kinds of cross-sectional shapes with no play. The fastening surface body can securely engage a surface fastener of a sheet member to which a female surface fastener is mounted, where the fastening body includes a flat substrate having a surface comprising male engaging elements. The fastening body is structured so as to be fitted and fixed to fitting groove portions of the mounting body so as to bond and fix various kinds of sheet members. Each fitting groove portion of the of the mounting body generally has a C-shaped cross section formed with openings along both end edges of a widthwise direction. The fastening body has at least a protrusion having a height so that that the protrusion contacts a surface of the mounting body when the fastening body is fitted and fixed to the mounting body. The protrusion also extends in parallel to the fitting groove portions at least at a center portion in a widthwise direction on a surface opposite to the surface from which the male engaging elements protrude. Accordingly, it is possible to mount the sheet-like fastening body with no play even when the fastening body is thinner than a height of the opening of the fitting groove portions of the mounting body. Further, the protrusions can support the fastening body in a horizontal state against an external pressing force.

20 Claims, 4 Drawing Sheets

FASTENING BODY FOR SHEET MEMBER

BACKGROUND OF THE INVENTION

1. Field of the Invention

The present invention relates to a fastening body for fastening various kinds of sheet members to a mounting portion, and more particularly to a strip-shape fastening body having a multiplicity of synthetic resin male engaging elements for a surface fastener which is used for suspending various kinds of screens such as a curtain, a screen for a projection, a blackout curtain, a suspended screen for an advertisement and the like to a suspending portion, or adhering an interior material such as various kinds of wallpapers, carpets and the like to various kinds of panels.

2. Description of the Related Art

Conventionally, there has been suggested, for example, in Japanese Utility Model Laid-Open Publication No. 6-64591 that a curtain is fastened to a curtain rail by fitting and fixing a strip-shape curtain fastening body in which synthetic resin male engaging elements constituted by a multiplicity of hooks and the like project from a surface of a substrate in a longitudinal direction of the curtain rail so as to be integrally formed with the flat substrate. Female engaging elements of a surface fastener provided along an upper end edge portion of the curtain are engaged with the curtain fastening body having the male engaging elements, at a time of mounting the curtain to the curtain rail having a generally C-shaped cross section, for example. Such a fastening body can be used for adhering an interior member such as various kinds of wallpapers, carpets and the like to various kinds of panels (a wall or a floor) as well as being used for the curtain, as disclosed in, for example, Japanese Utility Model Laid-Open Publication No. 5-70313.

The fastening body disclosed in these publications intends to firmly fix the fastening body to the curtain rail by forming rows of projections comprising intermittently protruding projections on one surface disposed along both side edges (selvedges) of a widthwise direction of the strip-shape fastening body, mounting the projection rows to fitting groove portions formed at both end edges of the curtain rail as a mounting body in the widthwise direction with their openings facing each other, for example, and pressing an inner wall surface of the fitting groove portions in the curtain rail by the projection rows, in addition to the structure mentioned above.

Accordingly, in accordance with the fastening body disclosed in each of the publications mentioned above, since the fastening body is elastically gripped by the inner wall of the fitting groove portions in the flat mounting body due to the projection rows, a firm fixation can be realized, however, since a rear surface of the flat substrate in the fastening body is brought into closely contact with a bottom surface of the mounting body in both cases, an engaging element protruding surface of the flat substrate of the fastening body becomes lower than the fitting groove portions by a height of the projection rows, and the engaging elements protruding from the flat substrate has less portion protruding from an upper surface of the mounting body, so that in order to secure a desired engaging rate, it is necessary to set a height of a rising portion of the engaging element higher by a height of the projection rows. This means that the rising portion of the engaging element becomes significantly bendable at the same thickness, so that it becomes hard to obtain an ideal engaging strength as the engaging element.

Further, in accordance with another fastening body disclosed in Japanese Utility Model Laid-Open Publication No. 5-70313, the projection rows mentioned above are provided on front and rear surfaces of the flat substrate, and the projection rows on the front and rear surfaces are fitted to the fitting groove portions. However, in the fastening body structured in the above manner, since a gap corresponding to the height of the projection rows is generated between the rear surface of the flat substrate and the bottom surface of the mounting body, the flat substrate of the fastening body is recessed inwardly to the mounting body by that gap when a product to which a female surface fastener is mounted is pressed against the fastening body to fasten it, so that an engagement with the male engaging elements is insufficiently achieved and it is most likely that a function as a fastening body can not be sufficiently obtained.

Further, in general, this kind of mounting body is continuously produced by extrusion as a long-shaped member having a predetermined cross section from a metal material. In this case, a cross sectional size of the shaped member is not necessarily uniform. Still further, a cross sectional shape of the mounting body is various, for example, and a transverse cross section between right and left fitting groove portions may be curved like a bow. On the other hand, the fastening body is made of a thermoplastic synthetic resin material and is continuously molded by an injection molding. However, taking a production efficiency and the like into consideration, it is not always a good measure to change a mold die and the like, and it is desired to mass produce the fastening bodies having the same width and the same shape.

Accordingly, as the fastening body disclosed in the publication mentioned above, in order to easily mount the fastening body to the companion mounting body by forming the projection rows along the end edges of the widthwise direction, it is necessary to set the height of the projection rows slightly lower than the height of the openings of the fitting groove portions. In the case that an accuracy therefor can not be obtained, a firm mounting can not be achieved, or it is impossible to mount the projection rows to the fitting groove portions.

Further, in the mounting body in which the transverse cross section is curved like a bow, when mounting the fastening body to the mounting body, a gap is generated between the curved surface of the mounting body and the fastening body, so that the flat substrate of the fastening body is recessed inwardly to the mounting body along the curved surface in the same manner as mentioned above when pressing the product in which the female surface fastener is mounted so as to fasten to the fastening body. Accordingly, a portion at which an engagement with the male engaging elements is insufficiently performed is generated in the center portion of the female surface fastener, so that there is a case that it is impossible to sufficiently achieve a function as the fastening body.

SUMMARY OF THE INVENTION

An object of the present invention is to provide a fastening body which can securely perform a fastening to a female surface fastener product without an inward recessing of the fastening body to a mounting body at a time of engaging with the companion female surface fastener, that is, without influence of a cross sectional shape of the mounting body even when a gap is generated between a bottom surface of the mounting body and the fastening body.

The object mentioned above can be achieved by a fastening body for a sheet member in accordance with a first aspect of the invention. That is, in accordance with the first aspect of the invention, there is provided a fastening body for a sheet member which is fitted and fixed to fitting groove portions of a mounting body and which bonds and fixes various kinds of sheet member, each of the fitting groove portions having a generally C-shaped cross section formed with openings along both end edges of a widthwise direction. The fastening body comprises a flat substrate having fitting edge portions inserted into the fitting groove portions at both end edges of the widthwise direction and a multiplicity of synthetic resin male engaging elements of a surface fastener which integrally protrudes from one surface between the fitting edge portions of the flat substrate, and at least a protrusion having a height substantially equal to a height of the opening of the fitting groove portion including a thickness of the flat substrate and extending in parallel to the fitting groove portions is provided at at least a center portion in a widthwise direction of a surface opposite to the surface to which synthetic resin male engaging elements of the flat base portion are protruded.

That is, even in the case, for example, that a transverse cross sectional shape between the right and left fitting groove portions of the mounting body is curved like a bow, since front ends of the protrusions extending in a longitudinal direction and protruded from the center portion of the rear surface of the flat substrate of the fastening body are brought into contact with or come close to the curved bottom surface of the mounting body, the protrusions serve as a stopper when pressing the product to which the female surface fastener is mounted so as to fasten to the fastening body. Therefore, the female surface fastener and the male engaging elements are securely engaged with each other without an inward recessing of the flat substrate to the mounting body along the curved surface, and a function as the fastening body can be sufficiently achieved.

Preferably, a height of at least a protrusion protruded from the center portion in the widthwise direction of the flat substrate among the protrusions is set to be higher than the other protrusions. By setting the height of the protrusion protruded from the center portion in the widthwise direction of the flat substrate higher than the other protrusions, for example, even in the case that the mounting body has the curved surface as mentioned above or the mounting body is the flat surface, the protrusion having greater height serves as the stopper at least in the center portion of the width of the fastening body, so that a fastening of the female surface fastener product can be securely performed.

Preferably, the protrusions may be continuously extended all along the flat substrate. Alternatively, the protrusions may be discontinuously extended all along the flat substrate.

When arranging protruded positions of the adjacent protrusions in the widthwise direction in a zigzag manner by shifting the protruded positions in a vertical direction with respect to each other in the case that the protrusions are discontinuously extended all along the flat substrate, it is possible to prevent the fastening body from tearing in the longitudinal direction when bending the fastening body. However, when it is intended to easily bend in both of the longitudinal direction and the widthwise direction, it Is desired to coincide the protruded positions of the protrusions adjacent in the widthwise direction with each other in the longitudinal direction.

Further preferably, continuous or discontinuous recess grooves are formed between a multiplicity of male engaging elements disposed along the longitudinal direction and/or the widthwise direction of the flat substrate. Due to existence of the recess grooves, the fastening body is easily bent along the recess groove even when the fastening body is formed to be thick, so that it is easy to mount the fastening body to the fastening groove portion of the mounting body.

DESCRIPTION OF THE PREFERRED EMBODIMENTS

Figure 1:
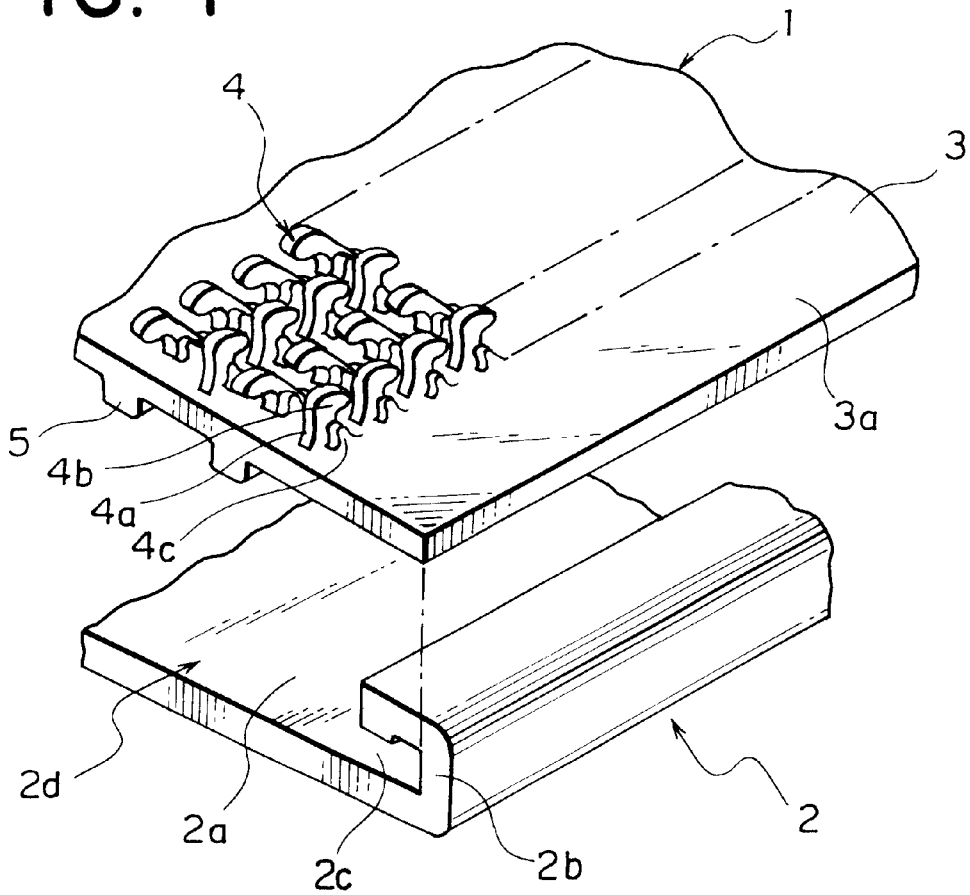
FIG. 1 is a fragmentary exploded perspective view showing a structure of a main portion of a fastening body and a mounting body thereof in accordance with a first embodiment of the present invention.
Figure 2:
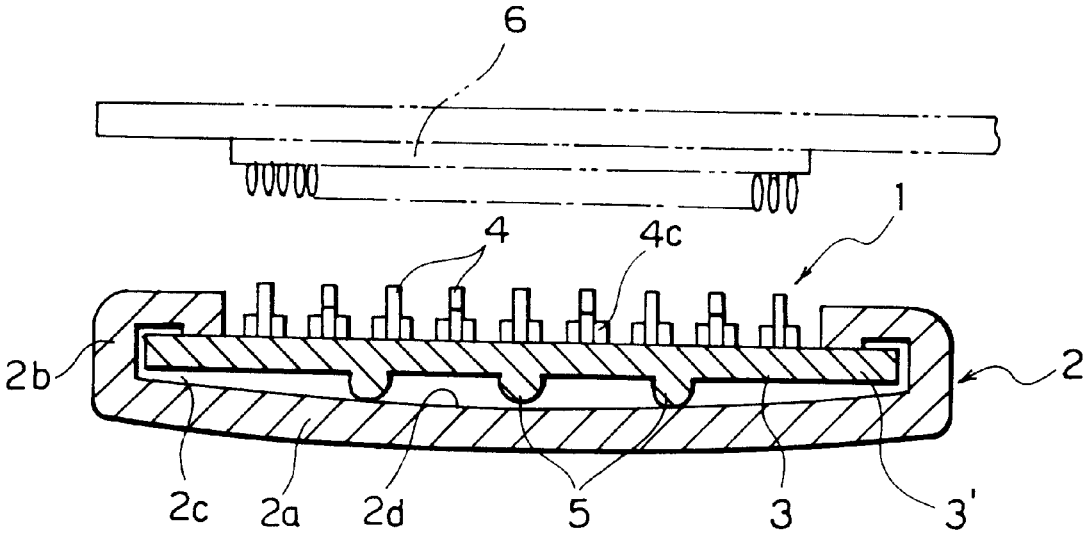
FIG. 2 is a cross-sectional view showing a mounting state when the fastening body is mounted to the mounting body.

Hereinafter, a preferred embodiment of the present invention will be described below with reference to the accompanying drawings. FIG. 1 is an exploded perspective view of a main portion showing a mounting state of a fastening body for a sheet member to a flat mounting body in accordance with a typical embodiment of the present invention and FIG. 2 is a cross-sectional view showing a mounting state of the fastening body for the sheet member with respect to the mounting body.

In these drawings, reference numeral denotes a fastening body for a sheet member in accordance with the present invention, and reference numeral 2 denotes a flat mounting body in which the fastening body 1 for the sheet member is fitted. In accordance with the illustrated embodiment, the flat mounting body 2 is, for example, a curtain rail applied to a curtain apparatus vertically opening and closing a curtain (not shown), in which L-shaped mounting edges 2*b* are integrally formed along both side edges of a widthwise direction of a long curved flat mounting portion 2*a* having a bow-like cross section and both side edge portions are opposed to each other so as to form a generally C-shaped cross section, thereby forming fastening groove portions 2*c* of the fastening body 1. The structure mentioned above is substantially the same as that of the conventional mounting body.

On the other hand, the fastening body 1 for the sheet member has a flat substrate 3 having a length substantially the same as that of the curved flat mounting body 2, a width substantially the same as a distance between the opposing fitting groove portions 2*c* on a bottom surface 2*d* and a thickness slightly smaller than a height of a groove of the fitting groove portion 2*c*, and has a multiplicity of hook-shaped male engaging elements 4 integrally protruded from the substrate 3 on one surface of a center portion of the flat substrate 3 (hereinafter, referred as "the substrate") except fitting edge portions 3' at both ends in a widthwise direction. Each of the hook-shaped engaging elements 4 has a rising portion 4*a* standing from the substrate 3 and a curved portion 4*b* extending from the rising portion 4*a* in a longitudinal direction of the substrate 3 and having a front end bending toward the substrate 3. And further, in the illustrated embodiment, a reinforcing rib 4*c* having a desired height is integrally provided on each side surface of the rising portion 4*a*. Of course, a shape of the hook-shaped engaging element 4 is not limited to the illustrated embodiment, and it may be a male engaging element having a mushroom-shaped or cotyledon-shaped curved portion in place of the hook-shaped engaging element.

Figure 5:
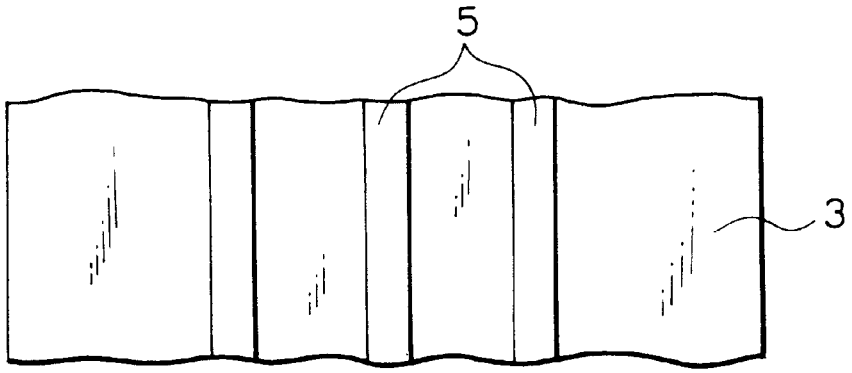
FIG. 5 is a fragmentary rear view showing an example of an arrangement of protrusions formed on a rear surface of the fastening body.
Figure 6:
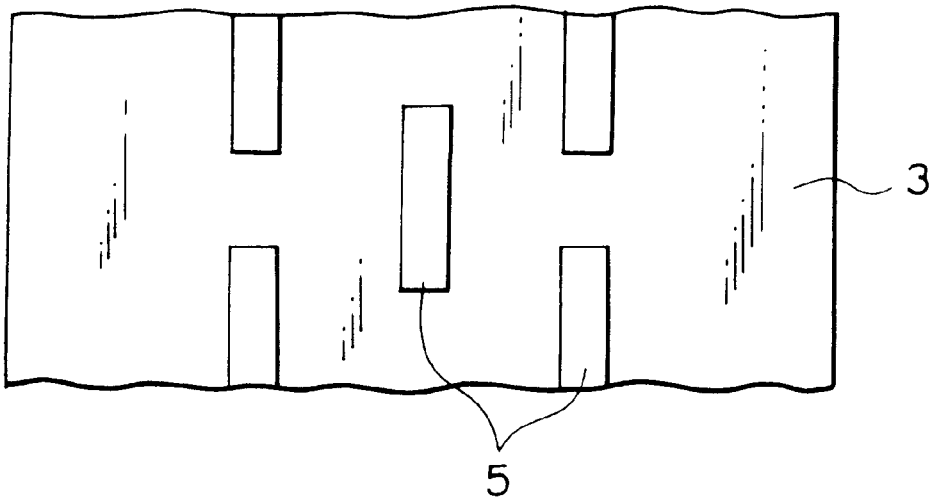
FIG. 6 is a fragmentary rear view showing another example of an arrangement of the protrusions.

Further, in accordance with the present invention, on a surface (a rear surface) opposite to a surface having the male engaging elements 4 of the flat substrate 3, three protrusions 5 are extended in a longitudinal direction in the center portion in the widthwise direction at a predetermined interval. In this embodiment, all of protruding sizes of three protrusions 5 are set to be the same. Further, three protrusions 5 may be continuously extended as shown in FIG. 5, or each of linearly extending protrusions 5 may be discontinuously extended in a longitudinal direction as shown in FIG. 6. Here, in an arrangement example of the protrusions 5 shown in FIG. 6, protruding positions of the protrusions 5 disposed adjacently in a widthwise direction of the substrate 3 are shifted in a longitudinal direction and the protrusions 5 are totally arranged in a zigzag manner. Due to the arrangement mentioned above, it is hard to tear the fastening body 1 in both of the longitudinal direction and the widthwise direction, so that a durability is improved. However, in the case of intending to structure the fastening body 1 so that the fastening body 1 is easy to be bent in the longitudinal direction and the widthwise direction, the protruding positions of the protrusions 5 may be completely coincided in the widthwise direction of the substrate 3.

In accordance with the structure mentioned above shown in FIG. 2, the protrusion 5 arranged in the center in the widthwise direction among three protrusions 5 is not brought into contact with the bottom surface 2*d* corresponding to the curved surface of the curved flat mounting portion 2*a* and is in a state of floating from the bottom surface 2*d*, however, since both adjacent protrusions 5 are brought into contact with the bottom surface 2*d*, it is possible to mount the sheet-like fastening body 1 with no play even in the case that a thickness of the substrate 3 of the sheet-like fastening body 1 is smaller than a width of the opening of the fitting groove portion 2*c* in the mounting body 2. And the center portion of the fastening body 1 in the widthwise direction is supported by two protrusions 5 brought into contact with the bottom surface 2*d* of the mounting portion 2*a* when pressing a companion female surface fastener 6 of a product to which the female surface fastener 6 is mounted onto an engaging surface having the hook-shaped engaging elements 4 of the fastening body 1, so that the center portion is not deformed along the curved surface of the curved flat mounting portion 2*a*. Accordingly, it is possible to securely engage the female surface fastener 6 with the fastening body 1.

Figure 3:
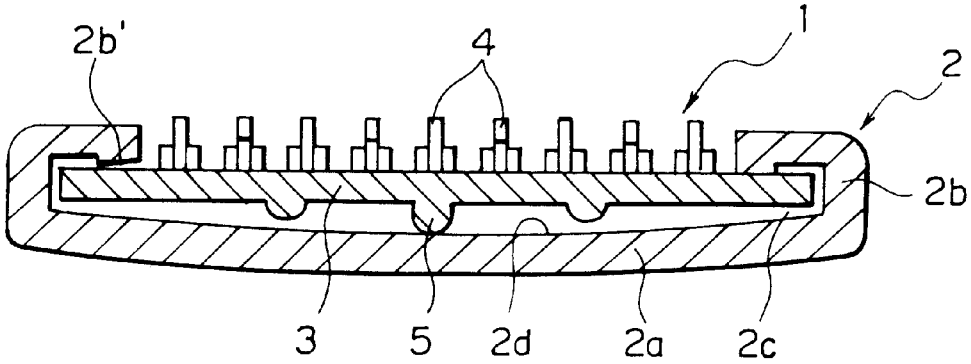
FIG. 3 is a cross-sectional view showing a mounting state between a fastening body and a mounting body in accordance with a modification of the embodiment.

FIG. 3 shows a modification of the foregoing embodiment, and in accordance with this modification, a protruding size of the central protrusion 5 among three protrusions is set to be larger than that of the other protrusions 5, so that only the central protrusion 5 is brought into contact with the bottom surface 2*d* corresponding to the curved surface of the curved flat mounting portion 2*a*. Accordingly, since the central protrusion 5 prevents the fastening body 1 from recessing, the fastening body 1 does not deform in a direction toward the bottom surface 2*d* of the curved flat mounting portion 2*a* when the female surface fastener 6 of the product to which the female fastener 6 is mounted is pressed against it, and a flat shape is secured, so that the product can be securely fastened. Further, in this modification, since the structure is made such that an opposing end surface of one mounting edge 2*b* among the pair of mounting edges 2*b* formed in the right and left side edge portions of the flat mounting body 2 is formed as a taper surface 2*b'* expanding outward, it is possible to easily insert the end edge of the fastening body 1 to the fitting groove portion 2*c* formed between the curved flat mounting portion 2*a* and the mounting edges 2*b*.

Figure 4:
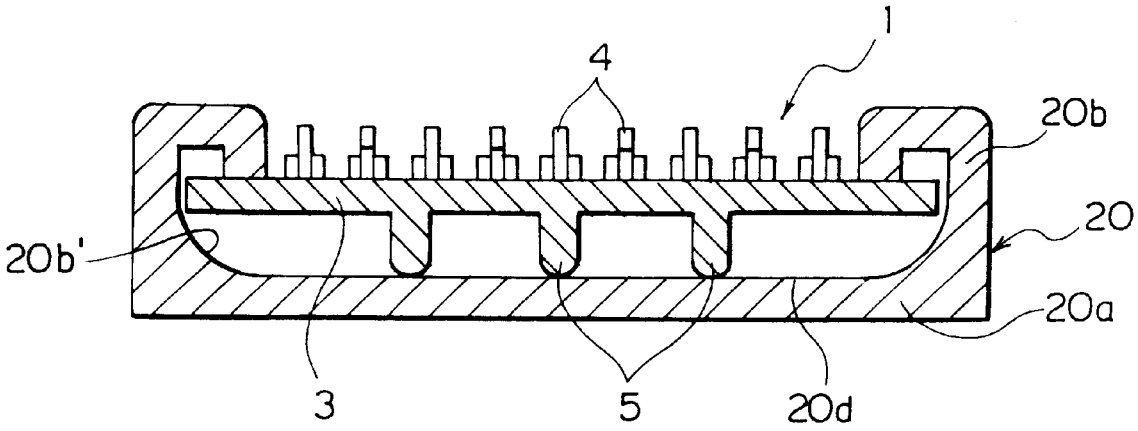
FIG. 4 is a cross-sectional view showing a mounting state between a fastening body and a mounting body in accordance with a second embodiment of the present invention.

FIG. 4 shows a second embodiment of the present invention. In accordance with this embodiment, inner wall surfaces of rising base end portion 20*b'* of mounting edges 20*b* standing up from both right and left end edges of a flat mounting portion 20*a* of a mounting body 21 and extended in a longitudinal direction are vertically curved, and a bottom surface 20*d* of the flat mounting portion 20*a* is formed in a flat surface. On the other hand, all of a plurality of (three in the illustrated embodiment) protrusions 5 extending in a longitudinal direction in a parallel manner on a rear surface of a center portion in a widthwise direction of the fastening body 1 have the same height. Therefore, in accordance with the fastening body 1 according to the present embodiment, it is possible to prevent the fastening body 1 from deforming by three protrusions 5 even when pressing the female surface fastener 6 of the product to which the female fastener 6 is mounted, to the fastening body 1, so that it is possible to securely fasten the product to the fastening body 1.

Figure 7:
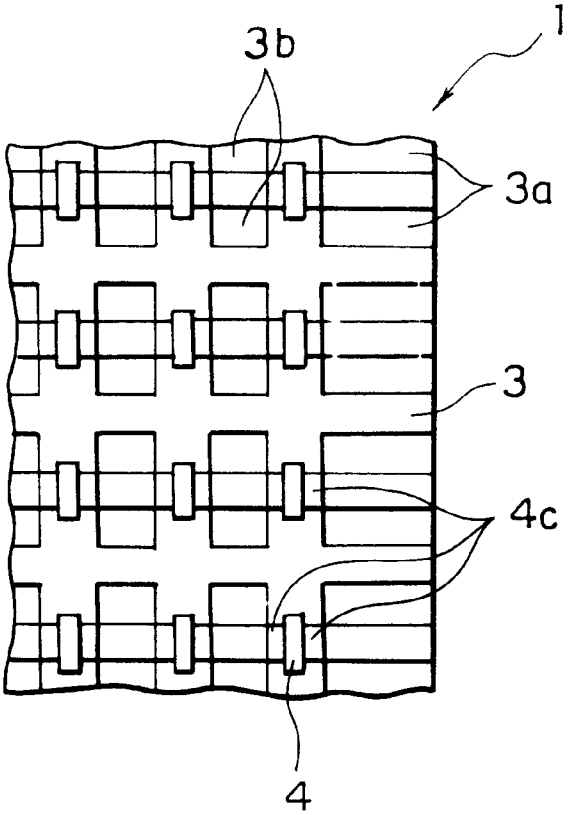
FIG. 7 is a fragmentary top plan view of a fastening body in accordance with a third embodiment of the present invention.
Figure 8:
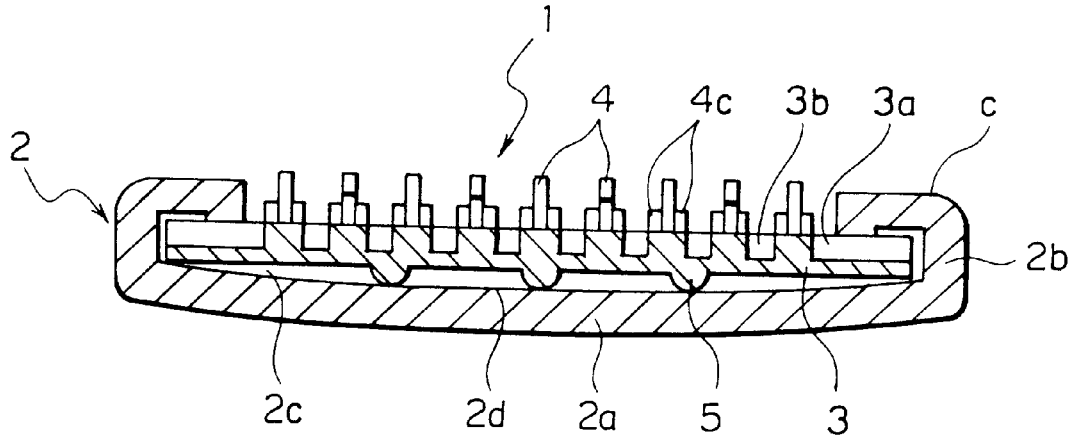
FIG. 8 is a cross-sectional view of a mounting body to which the fastening body in accordance with the third embodiment is mounted.
Figure 9:
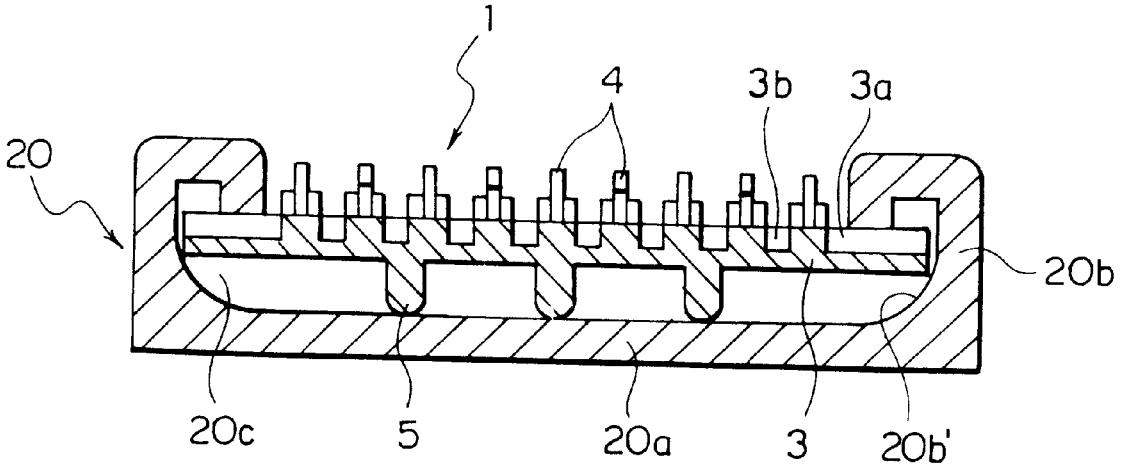
FIG. 9 is a cross-sectional view of a mounting body to which the fastening body is mounted, in accordance with a modification of the third embodiment.

FIG. 7 shows a third embodiment of the present invention, and in accordance with this embodiment, in both end portions in a widthwise direction of the substrate 3, a multiplicity of recessed grooves 3*a* extending in a widthwise direction are formed on a surface of the substrate 3 at portions on arranging lines of a multiplicity of male engaging elements 4 arranged in a widthwise direction and except for center portions between the male engaging elements 4 in a longitudinal direction. And a multiplicity of rectangular recess grooves 3*b* are formed on the surface of the substrate 3 in both sides of in a longitudinal direction and except for a straight line portion which is disposed between the male engaging elements 4 adjacent in a widthwise direction of the substrate 3 and connects the male engaging elements 4. These recess grooves 3*a* and 3*b* not only provide a suitable deformability to the substrate 3 in the case that the substrate 3 is rigid, but also serve to correct a curved shape generated in a widthwise direction of the substrate 3 at a time of molding. FIGS. 8 and 9 show a state of inserting and fitting the sheet-like fastening body 1 in which the recess grooves 3*a* and 3*b* mentioned above are formed on the surface of the substrate 3 to the mounting body 2 having the same structure as shown in FIGS. 1 and 4, respectively.

As is clear from the foregoing description, in accordance with the sheet-like fastening body 1 of the present invention, since one or more protrusions 5 extending in a longitudinal direction are provided in at least the center portion in a widthwise direction on the surface (the rear surface) opposite to the surface of the substrate 3 on which the engaging elements 4 are formed, the sheet-like fastening body 1 can be fitted to the flat mounting body 2 with no play when fitting the sheet-like fastening body 1 to the fitting groove portion 2*c* formed between the mounting portion 2*a* and the mounting edges 2*b* in the flat mounting portion 2, even if the bottom surface 2*d* of the flat mounting portion 2*a* is the curved surface (in the embodiment mentioned above, the center portion or both ends are provided with the curved surface), in the case that the flat mounting body 2 structured such that the mounting edges 2*b* having a substantially inverted-L-shaped cross section are integrally formed with the openings thereof facing to each other along both end edges in a widthwise direction of the long flat mounting portion 2*a* has various kinds of cross-sectional shapes, for example. Further, since the front ends of the protrusions 5 provided on the rear surface of the fastening body 1 are brought into contact with the bottom surface 2*d*, the substrate 3 deforms toward the bottom surface 2*d* of the mounting body 2 when pressing the female surface fastener 6 of the product to which the female surface fastener 6 is mounted, to the engaging surface having the male engaging elements 4 of the fastening body 1, so that it is possible to securely fasten the product to the fastening body 1.

In particular, by differentiating the height of the plurality of protrusions 5 arranged in line in the center portion in the widthwise direction, since one of the protrusions 5 prevents the fastening body 1 from deforming irrespective to a shape of the bottom surface 2*d*, an engagement between the fastening body 1 mounted to the sheet-like mounting body 2 having various kinds of cross-sectional shape and the female surface fastener 6 mounted to the product can be securely performed, so that the structure can be applied to the wide variation of sheet-like mounting body 2.

Further, in the case of forming a suitable number of the recess grooves having a suitable shape on the male engaging element forming surface in the substrate 3 of the fastening body 1, the substrate 3 can be easily bent in a longitudinal direction and/or a widthwise direction of the fastening body 1 even when the substrate 3 is formed to be thick, thereby increasing a rigidity, so that it is easy to fit and insert to the fitting groove portion 2*c* of the mounting body 2.

Here, the above description is given only for explaining the representative embodiment in accordance with the present invention, and for example, a shape of the male engaging elements is not limited to a hook shape, but can employ a mushroom shape or a palm tree shape, so that the present invention can be variously modified within a range of the technical matters described in attained aspects of the invention.

What is claimed:

1. A combination of a fastening body for a sheet member capable of bonding and fixing various kinds of sheet members and a mounting body in which said fastening body is fitted and fixed, said mounting body having two fitting groove portions formed along both end edges of a widthwise direction of said mounting body, each of said fitting groove portions having a generally C-shaped cross-section defining an opening, said fastening body comprising a flat substrate having two fitting edge portions capable of being inserted into said openings defined by said fitting groove portions of said mounting body, said fitting edge portions formed along both end edges of a widthwise direction of said fastening body, a multiplicity of male engaging elements of a fastener integrally protruding from one surface of said fastening body between said fitting edge portions, and at least one protrusion provided at at least a center portion in the widthwise direction on a surface of said fastening body opposite to the surface from which said male engaging elements protrude, said at least one protrusion extending parallel to said fitting groove portions of said mounting body wherein a height of both said at least one protrusion and said flat substrate is substantially equal to a height of said openings defined by said fitting groove portions of said mounting body.

2. The combination of claim 1 further including a plurality of protrusions, each protrusion provided on said surface of said fastening body opposite to said surface from which said male engaging elements protrude.

3. The combination of claim 2 wherein a height of at least one protrusion protruded at least in the center portion of the substrate is higher than the other protrusions.

4. The combination of claim 2 wherein said protrusions are continuously extended all along said flat substrate.

5. The combination of claim 2 wherein said protrusions are discontinuously extended all along said flat substrate.

6. The combination of claim 1 further comprising recess grooves formed between said multiplicity of male engaging elements disposed along a longitudinal direction of said flat substrate.

7. The combination of claim 6 further comprising recess grooves formed between said multiplicity of male engaging elements disposed along a widthwise direction of said flat substrate.

8. The combination of claim 1 further comprising recess grooves formed between said multiplicity of male engaging elements disposed along a widthwise direction of said flat substrate.

9. The combination of claim 8 further comprising recess grooves formed between said multiplicity of male engaging elements disposed along a longitudinal direction of said flat substrate.

10. The combination of claim 1 wherein said male engaging element are comprised of synthetic resin.

11. A combination of a fastening body for a sheet member capable of bonding and fixing various kinds of sheet members and a mounting body, said mounting body comprising:

a bottom surface, and two fitting groove portions formed along both end edges of a widthwise direction of said mounting body, said fitting groove portions extending from said bottom surface, each of said fitting groove portions having a generally C-shaped cross-section defining an opening, and said fastening body capable of being fitted and fixed to said mounting body, said fastening body comprising:

a flat substrate having two fitting edge portions capable of being inserted into said openings defined by said fitting groove portions of said mounting body, said fitting edge portions formed along both end edges of a widthwise direction of said fastening body, a multiplicity of male engaging elements of a fastener integrally protruding from one surface of said fastening body between said fitting edge portions, and at least one protrusion provided at at least a center portion in the widthwise direction on a surface of said fastening body opposite to the surface from which said male engaging elements protrude, said at least one protrusion extending parallel to said fitting groove portions of said mounting body, wherein said at least one protrusion contacts said bottom surface of said mounting body when said fastening body is fitted and fixed to said mounting body.

12. The combination of claim 11 further including a plurality of protrusions, each protrusion provided on said surface of said fastening body opposite to said surface from which said male engaging elements protrude.

13. The combination of claim 12 wherein a height of at least one protrusion protruded at least in the center portion of the substrate is higher than the other protrusions.

14. The combination of claim 12 wherein said protrusions are continuously extended all along said flat substrate.

15. The combination of claim 12 wherein said protrusions are discontinuously extended all along said flat substrate.

16. The combination of claim 11 further comprising recess grooves formed between said multiplicity of male engaging elements disposed along a longitudinal direction of said flat substrate.

17. The combination of claim 16 further comprising recess grooves formed between said multiplicity of male engaging elements disposed along a widthwise direction of said flat substrate.

18. The combination of claim 11 further comprising recess grooves formed between said multiplicity of male engaging elements disposed along a widthwise direction of said flat substrate.

19. The combination of claim 18 further comprising recess grooves formed between said multiplicity of male engaging elements disposed along a longitudinal direction of said flat substrate.

20. The combination of claim 11 wherein said male engaging elements are comprised of synthetic resin.

* * * * *